US006940407B2

(12) United States Patent
Miranda-Knapp et al.

(10) Patent No.: US 6,940,407 B2
(45) Date of Patent: Sep. 6, 2005

(54) METHOD AND APPARATUS FOR DETECTING LOSS AND LOCATION OF A PORTABLE COMMUNICATIONS DEVICE

(75) Inventors: Carlos A. Miranda-Knapp, Miramar, FL (US); Wayne W. Ballantyne, Coconut Creek, FL (US); Jaime A. Borras, Hialeah, FL (US); Joseph L. Dvorak, Boca Raton, FL (US); Sacha B. Holland, Coral Springs, FL (US)

(73) Assignee: Motorola, Inc., Schaumburg, IL (US)

( * ) Notice: Subject to any disclaimer, the term of this patent is extended or adjusted under 35 U.S.C. 154(b) by 48 days.

(21) Appl. No.: 10/650,287

(22) Filed: Aug. 28, 2003

(65) Prior Publication Data

US 2005/0046580 A1 Mar. 3, 2005

(51) Int. Cl.[7] ..... G08B 13/14

(52) U.S. Cl. ..... 340/572.1; 340/568.1; 340/571; 340/573.4; 340/539; 340/686.6

(58) Field of Search ..... 340/568.1, 571, 340/572.1, 573.4, 686.6, 539, 10.1, 568.7, 686.1, 686.3, 689; 455/410, 418

(56) References Cited

U.S. PATENT DOCUMENTS

| | | | | | |
|---|---|---|---|---|---|
| 5,006,676 | A | | 4/1991 | Bogut et al. | |
| 5,373,125 | A | | 12/1994 | Ford et al. | |
| 5,578,991 | A | | 11/1996 | Scholder | |
| 5,760,690 | A | * | 6/1998 | French | 340/571 |
| 5,796,338 | A | | 8/1998 | Mardirossian | |
| 5,861,808 | A | * | 1/1999 | Lehmann et al. | 340/571 |
| 6,172,607 | B1 | * | 1/2001 | McDonald | 340/571 |
| 6,265,974 | B1 | * | 7/2001 | D'Angelo et al. | 340/568.1 |
| 6,362,736 | B1 | * | 3/2002 | Gehlot | 340/568.1 |
| 6,556,819 | B2 | * | 4/2003 | Irvin | 455/410 |
| 2002/0113705 | A1 | * | 8/2002 | Wallace | 340/568.7 |

* cited by examiner

*Primary Examiner*—Jeffery Hofsass
*Assistant Examiner*—Lam Pham

(57) ABSTRACT

A portable communication device (10) includes a transceiver (12 and 14), an acceleration sensor (20) coupled to the transceiver, and a processor (16) coupled to the acceleration sensor. The processor is programmed to monitor (32) an acceleration profile of the portable communication device and compare (48 and 52) the acceleration profile of the portable communication device with at least one pre-stored acceleration profile (18).

27 Claims, 4 Drawing Sheets

METHOD AND APPARATUS FOR DETECTING LOSS AND LOCATION OF A PORTABLE COMMUNICATIONS DEVICE

CROSS-REFERENCE TO RELATED APPLICATIONS

Not applicable

FIELD OF THE INVENTION

This invention relates generally to portable communications devices, and more particularly to a method and system for detection and location of a portable communications device when missing.

BACKGROUND OF THE INVENTION

Current cellular technology fails to provide a fool-proof method or system enabling a user to detect if a user's phone has been dropped and to determine where the phone is located. The user can call their phone, but no one might hear it ring and no one might answer it even if they do hear it. Additionally, by the time a user realizes that their phone has been dropped or misplaced, the battery could potentially drain making any user call to the missing or misplaced phone essentially useless. If a user drops their phone, there is currently no way to detect this event. If the user later picks up the phone, this event cannot be detected either. Furthermore, current technology fails to account for battery thresholds and location in making a smart decision whether to enable a missing phone to report its location.

U.S. Pat. No. 5,796,338 issued Aug. 18, 1998 to Aris Mardirossian, for example, discusses a two part system including a transmitter-receiver pair where the transmitter is attached to the cell phone and the receiver is contained in a pager like device that is worn by the user. Thus, this approach requires that the user carry an extra electronic "gadget" which is highly undesirable. Also, Mardirossian's invention provides a delayed response because it waits until the received signals (at the device worn by the user) drop below a certain threshold or are not received for a predetermined period of time. Thus, if a user were to drop their cell phone, a few minutes could pass before they are notified of the event.

U.S. Pat. No. 5,578,991 issued Nov. 26, 1996 to Erica Scholder discusses providing a triggered alarm immediately after a portable computer is removed from its designated spot. However, if the user leaves the portable computer behind, the alarm would not trigger and thus the user would not be certain of the location of their device until some time later. Neither reference provides a way for the loss/theft prevention system to determine the location of the misplaced device or a way for the user to actively query the misplaced device to obtain information regarding its whereabouts. Other references discuss tilt switches and man-down devices that are designed to provide an alert or a signal if a radio remains in a predetermined position such as a horizontal orientation. Again, such devices do not effectively provide loss or theft prevention and further fail to provide location information either automatically or upon an active query. Another system known as the OnStar system from GM provides a combination of GPS receiver and cell phone, coupled to the vehicle's electronics. The GPS receiver is constantly tracking the vehicle's position, as long as GPS coverage is provided. When the air bag deploys (an event triggered by an accelerometer mounted on the vehicle), the cell phone is automatically activated to place a call to the OnStar dispatch center, whereupon the vehicle's location is reported. The OnStar system cannot automatically determine if the user's car has been lost or stolen. Instead, the driver must report whether the car has been stolen or lost. Also, while the OnStar system does optionally provide a cell phone capability to the user, the cell phone is not portable and inherently coupled to the vehicle. Moreover, the accelerometer sensor in OnStar is used to trigger an immediate call to the dispatch center without a corresponding analysis of the acceleration profile for distinct characteristics determinative of an action such as a phone drop or loss.

DETAILED DESCRIPTION OF THE DRAWINGS

A method and apparatus for detecting a dropped object or an object that has been dropped and subsequently picked up is useful in predicting if a user has misplaced the object. In the case where the object is a portable communications device such as a cellular phone, there are many embodiments herein that can instantly alert the user that the cellular phone was dropped.

The various embodiments discussed below present methods and devices to detect an event representing a drop of a device and optionally the detection of a pick-up or retrieval of the same device. The methods can include a "device loss detect" algorithm that processes these and other events and determines if the device has been lost or moved to a location outside a "safe zone", and whether the device should report its status. In other aspects, the methods can include a plurality of techniques to alert the user of a lost device and a means to enable a user to query the device's location regardless of whether the device loss detect algorithm actually deduces that the device has been lost.

Figure 1:
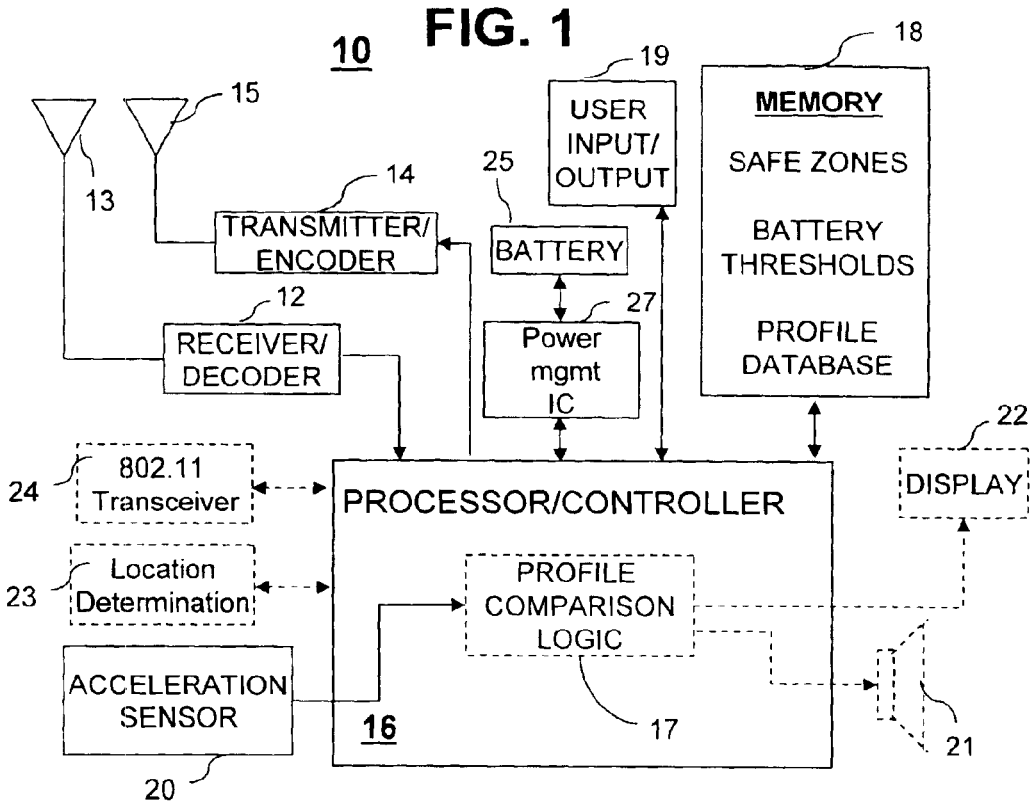
FIG. 1 is a block diagram of a portable communication device capable of detecting a loss condition in accordance with the present invention.

Referring to FIG. 1, a exemplary device such as a portable communication device 10 is shown capable of detecting a drop or a pickup of the device. In particular, the device 10 can be a cellular phone or other communication device having a motion-sensing device 20 such as an acceleration sensor or an accelerometer embedded in the device 10. The device 10 can also include a transceiver having a transmitter/encoder 14 and receiver/decoder 12 and respective antennas 15 and 13 coupled to a processor 16 as is well known in the art. The device 10 can optionally include another transceiver for shorter range communications such as a 802.11 transceiver module 24. The device 10 can also include a speaker 21, a display 22, and other various user input/output devices 19. The device 10 can also include a power source such as a battery 25 preferably interfacing with a power management IC 27. The power management IC 27 can output regulated voltages and can include an A/D converter to monitor the battery voltage. The motion-sensing device 20 can detect the impact resulting if the phone were dropped. The processor 16 can be a microprocessor or microcontroller (MCU) and can process the sensor signal from the motion sensing device 20 to determine if it matched a signature stored in memory 18 indicating that the phone had been dropped. The device can optionally include a logic module 17 for matching a signature or comparing a profile stored in memory 18. The memory 18 can optionally store other information such as a list of "safe zone" locations or coordinates and battery level thresholds (voltage and/or current) that can be useful in enabling certain phone functions as will be further explained below with respect to FIG. 5. The logic module 17 can be embedded in the processor 16 or can reside elsewhere in the device 10. Once the condition is detected, the device 10 can alert the user through audio and/or visual methods (flashing LEDs, lit up keypad, MIDI clip, text-to-speech alert, etc.) using at least one or more of the speaker 21, display 22, and other user input/output devices 19. If the phone were equipped with a location determination technology (GPS, EOTD, WLAN, etc.) such as location module 23, it can determine its location and report it (along with a timestamp) to the user through a phone call, an email, or a short messaging service (SMS) message that would be sent to pre-defined phone numbers or email addresses. Alternatively, if the user were to misplace the phone, the user could query the phone to request its location by calling the phone and entering a special code for example. Upon receiving the query request, the phone could potentially also automatically switch to a ring mode and raise the ring volume to a maximum level. In another scenario, a method in accordance with the invention can simply detect a device that is sitting idle (no movement) for some period of time (programmable by the user) in order to subsequently alert the user.

The portable communication device 10 can be a cellular phone, a two-way trunked radio, a combination cellular phone and personal digital assistant, a smart phone, a home cordless phone, or a satellite phone. It can also be any portable object, device or appliance having a transceiver such as an 802.11 transceiver. The basic idea of drop detection could be implemented in any wireless portable two-way communicator. Extending the idea to make use of the location determination technology would be applicable to any device equipped with such technology.

In the case of a cellular phone, embodiments of the idea aids in loss prevention of the phone by using technology that is typically already built into the phone (with the exception of an acceleration sensor, which is usually not included in the phone). The cellular phone embodiment uses the phone's own transceiver and messaging capabilities (voice, SMS, email, etc.) to communicate with the owner, as opposed to using a separate transmitter and receiver (pager worn by the user) as presented in U.S. Pat. No. 5,796,338. Thus, there is no requirement for a user to carry a second electronic device such as a separate receiver or transceiver. The method also provides "immediate" notification if the phone is dropped, hence risk of loss is reduced because the user does not have to wait until they are some distance from the phone before they are notified of the loss. Again, embodiments of the invention can use location determination technology that may already be present in the phone to meet the FCC's E-911 mandate. This technology could include GPS, Enhanced-Observed Time Difference (EOTD), WLAN based indoor location, etc. and thus provide tracking of the phone through a wide range of environments. Therefore, the methods in accordance with the invention not only notifies the owner that the phone was lost, but can also estimate a phone's location.

Figure 2:
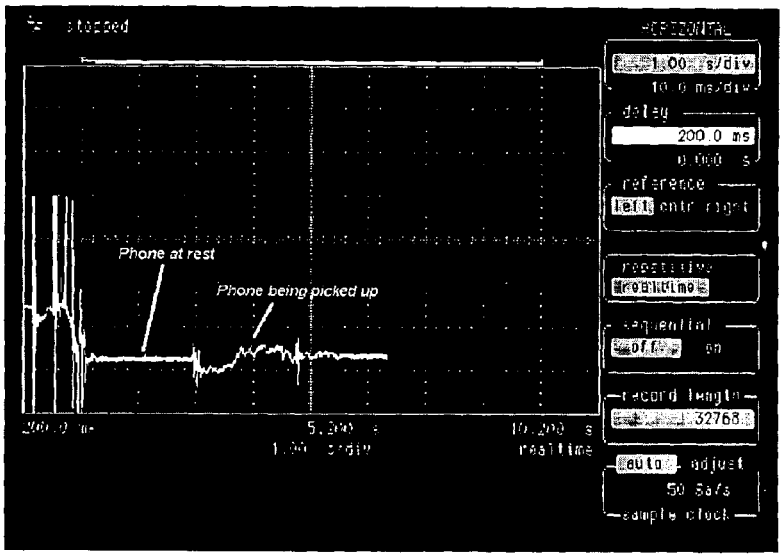
FIG. 2 illustrates a chart of an acceleration profile in accordance with the present invention.

Referring to FIG. 2, a signal trace of an acceleration profile (over time) for a phone as it goes through the process of being dropped to the ground and subsequently being picked up a few seconds after is shown. The trace was obtained by attaching a small accelerometer evaluation board onto the backside of a Motorola iDEN phone model i88s. The signal trace shows three distinct stages. The first stage of the acceleration profile contains large and rapid peak-to-peak signal swings corresponding to the acceleration transients that result when the phone impacts the ground. The second stage shows that the measured acceleration is constant (though not necessarily zero) when the phone is at rest. Note that although the phone is at rest, the accelerometer sensor still measures gravitational force along its axis. With a 3 axis accelerometer, the gravitational force vector can be measured relative to the orientation of these accelerometers. Thus, knowing the orientation of the accelerometers inside the phone, the MCU can predict or determine whether the phone ended face-up or face-down (or on its side, though this is unlikely.) This information could be useful to reduce current drain when alerting the user by opting to not light up a keypad and/or a display. Finally, the third stage shows the acceleration experienced by the phone as the user picks it up. The acceleration profile for this event is of a much smaller amplitude and slow changing. Clearly, the three events can be distinctly determined (measured) with the accelerometer, thus an algorithm can detect that the phone has been dropped and whether or not it was recovered.

Figure 3:
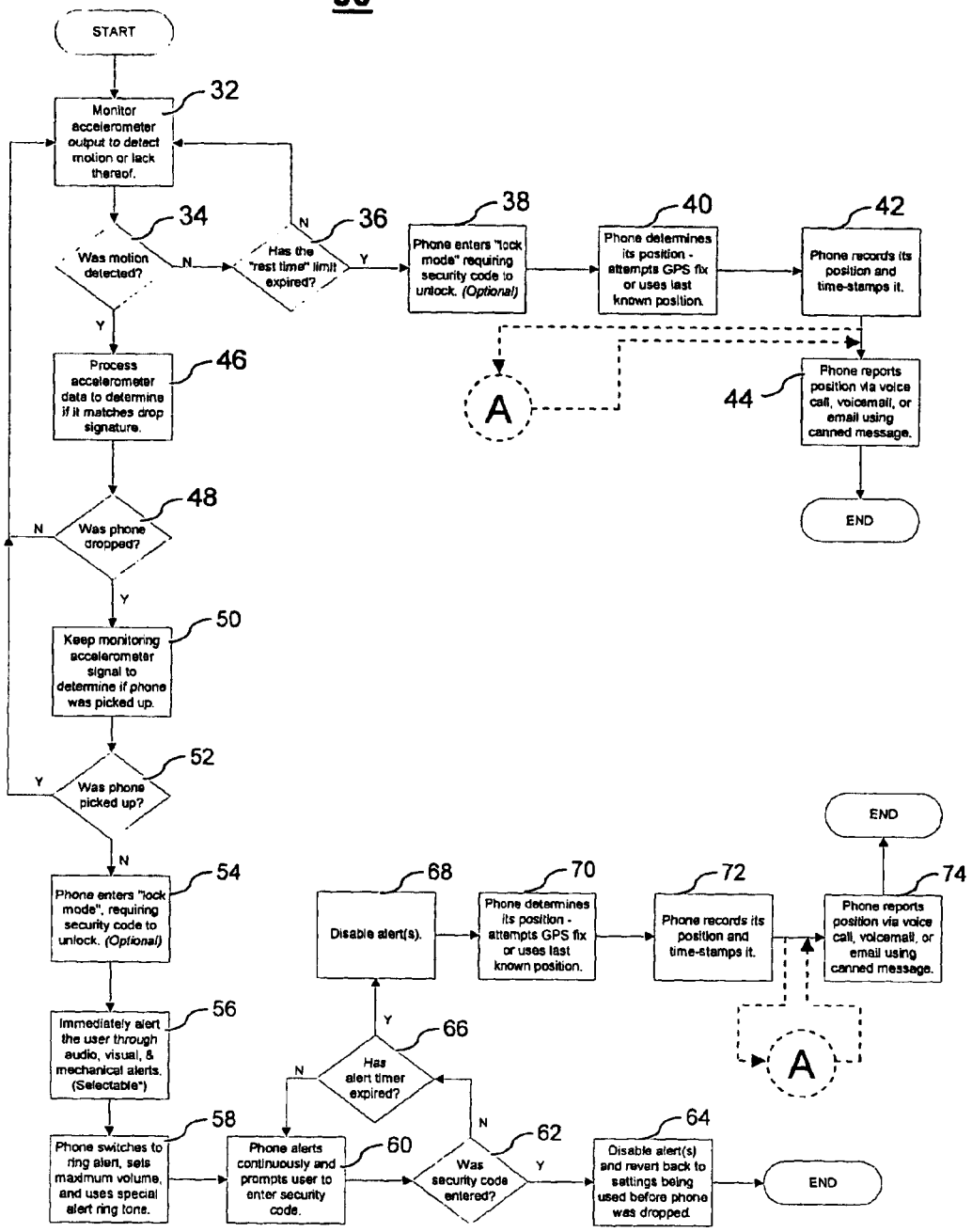
FIG. 3 illustrates a flow chart of a method of locating a portable communication device in accordance with the present invention.

Referring to FIG. 3, a method of location finding a portable communication device can include the steps of monitoring an acceleration profile at the portable communication device, and entering a secure mode which limits access to the portable communication device upon determining the acceleration profile matches a predetermined profile The predetermined profile can be a profile representing, for example, a dropped portable communication device, a vehicle in motion, or a portable communication device actually falling (but not yet hitting the ground). The method can also include the step of transmitting location information from the portable communication device to one among a predetermined phone number, a predetermined voicemail, a predetermined email, and a remote requestor having entered a predetermined access code. The location information can be obtained from GPS information, time of arrival techniques, or last known location information for example. A time stamp can also be transmitted in conjunction with the location information. Alternatively the method can also include the step of alerting at the cellular phone using at least one among a visual alert, an audible alert, a mechanical alert, and a tactile alert upon determining the acceleration profile matches the predetermined profile in the hope that the user will notice their misplaced phone.

More specifically, a method 30 starts by monitoring at step 32 the accelerometer's output and keeping track of the cumulative time that the acceleration is below a given threshold at decision block 34. If the time limit (typical value could be 48 hrs) expires at decision block 36 before any significant change in acceleration is detected, then the method 30 interprets this condition as an indication that the phone has not been moved and thus likely misplaced (or forgotten about) somewhere. At this point, the phone can enter a "security mode" or "lock mode" at step 38 that requires a security code for further access to the phone. The method 30 can further proceed to determine its position or location at step 40, record and time stamp the location information at step 42, and optionally transmit an alert message (preferably with the location and time stamp information) to the user via email, voicemail, etc. at step 44. Before the step of optionally transmitting the alert message, the method 30 can also have the communication device monitor its location for "safe zones" and also monitor its battery levels such as voltage levels, current levels or other battery parameters by going to "A" as further detailed with respect to FIG. 5. Since the phone or communication device waits for a rest period to expire, the communication device's battery could drain down making the communication device unable to transmit and report its position. Also, if the phone is left at rest, but in a "safe zone" such as the user's home or place of employment (or other user specified location designated as a "safe zone"), then certain transmissions or phone calls could be inhibited.

Figure 5:
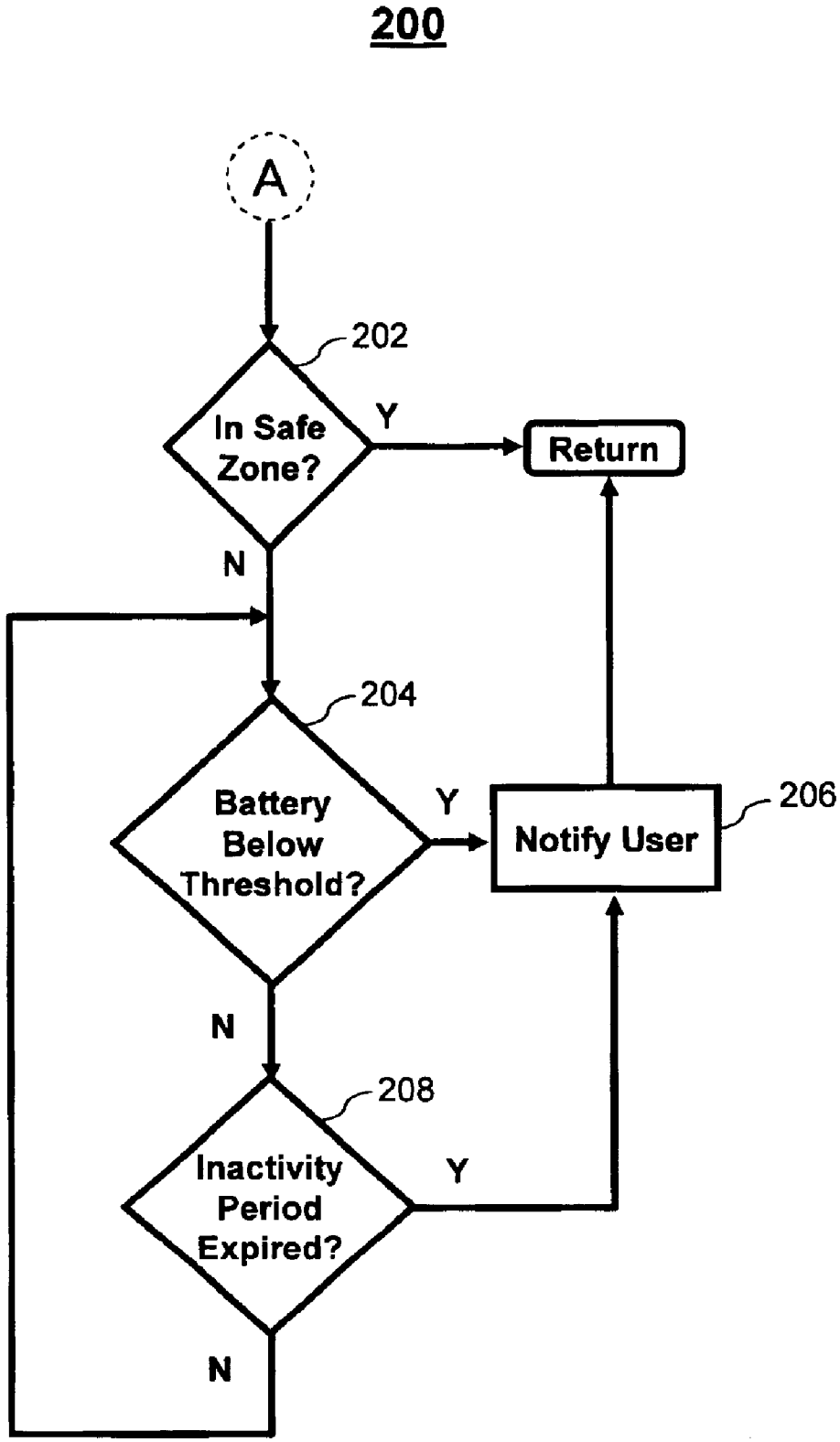
FIG. 5 illustrates a flow chart of an optional method of enabling a portable communication to report its location in accordance with the present invention.

More specifically, the sub-routine or method 200 of FIG. 5 can initially determine at the communication device whether the communication device is in one or more user defined "safe zones" at decision block 202. The determination that the user is in one of the "safe zones" can be determined using GPS coordinates, base transmitter IDs, EOTD, or other means known to those skilled in the art. The method 200 also monitors the battery at decision block 204. If the communication device is in a "safe zone" at decision block 202, then it is possible that a transmission to report its location is unnecessary and therefore the device should not call and merely return as shown. If the device is not in a "safe zone" at decision block 202 and the battery level is below a predetermined threshold at decision block 204, then the communication device should notify the user and otherwise report its status at step 206 before the battery drains. If the device is not in a safe zone and the battery level is not below the predetermined threshold, then an inactivity period is monitored at decision block 208. If an inactivity period has expired at decision block 208, then the user is notified once again at step 206. While the inactivity period is not expired at decision block 208, the method returns to monitor the battery at decision block 204. The transmissions could be sent to various different destinations with a predetermined priority. Preferably, the destinations can include a predetermined user's phone number, voicemail, email account, or even a friend's phone number, voicemail or email account.

Referring again to FIG. 3, if the method 30 detects motion beyond a predetermined threshold at decision block 34, then accelerometer data is processed at step 46 to determine if the data matches a drop profile or signature. If the acceleration profile is not indicative of a phone being dropped at decision block 48, then the method 30 returns to monitoring the accelerometer output at step 32. If the acceleration profile is indicative of the phone being dropped at decision block 48, then the acceleration signal can be monitored for a few more seconds to see if the phone was picked up at step 50. If the phone was picked up at decision block 52, the algorithm goes back to monitoring the accelerometer at step 32. If the phone was not picked up within the specified time limit (typical value could be 10 seconds) at decision block 52, then the phone can immediately alert the user at step 56 and optionally enter a security mode at step 54, and eventually transmit an alert message (with location information) to the user, again via email, voicemail, etc. at step 74. In conjunction with the alerting step 56, the phone can be switched to a ring alert where optionally the volume can be set to maximum and a special alert ring tone can be used at step 58. The phone can optionally alert continuously and prompt the user to enter a security code at step 60. If a security code is entered at decision block 62, the alert(s) can be disabled and the phone can revert back to settings used before the phone was dropped at step 64. If no security code is entered within a predetermined time at decision block 66, then the phone will continue to alert at step 60 until the predetermined time is expired at decision block 66. Upon the predetermined time, the alert(s) can be disabled at step 68, whereupon the phone can determine its location at step 70, preferably store its position and a corresponding time stamp at step 72 and transmit such information at step 74 (similar to steps 40, 42 and 44 respectively). Once again, before the transmission step 74, the method 30 can optionally have the communication device monitor its location for "safe zones" and also monitor its battery levels by going to "A" as previously explained above with respect to FIG. 5.

Figure 4:
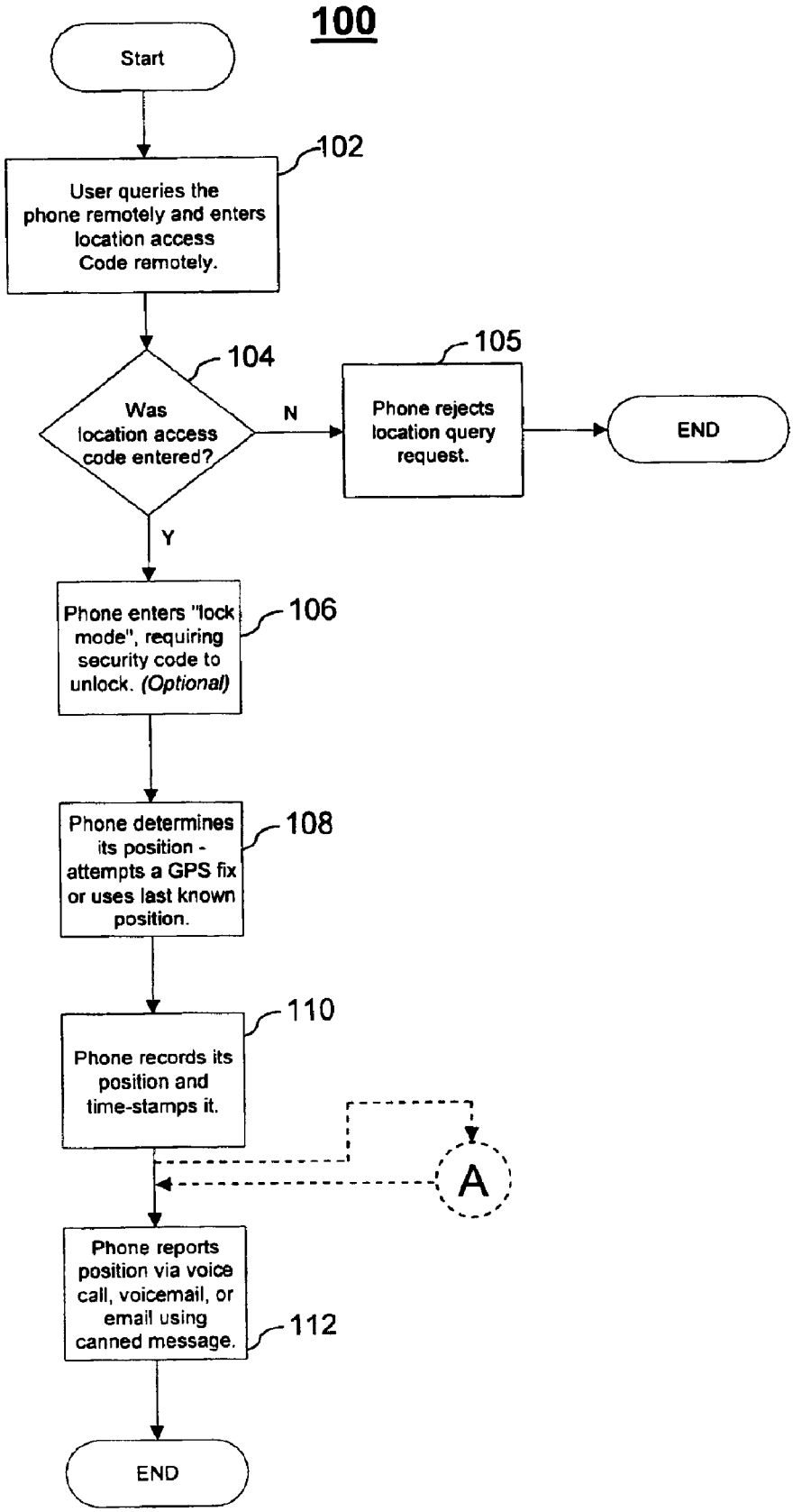
FIG. 4 illustrates a flow chart of a method of remotely querying a portable communication device for location information in accordance with the present invention.

Referring to FIG. 4, a method 100 can be executed when the user realizes they misplaced the phone and then queries the phone remotely at step 102. The remote query can be in a form of an SMS message, an IP message or a phone call by the user to phone. For the purposes of protecting the user's privacy, the algorithm or method can require that a location access code be entered at decision block 104. If no location access code is entered, the phone rejects any location query request at step 105. This additional code will prevent a third party from exploiting this remote phone query feature to find out the whereabouts of the user unbeknownst to them. Upon receiving the correct location access code at decision block 104, the algorithm goes through a sequence of steps of optionally securing the phone at step 106, determining its location at step 108, preferably storing its position and a corresponding time stamp at step 110 and transmitting such information at step 112 in a reply back to the requester. Similar to method 30, before the transmission step 112, the method 100 can optionally have the communication device monitor its location for "safe zones" and also monitor its battery levels by going to "A" as previously explained above with respect to FIG. 5.

In light of the foregoing description of the invention, it should be recognized that the present invention can be realized in hardware, software, or a combination of hardware and software. A method and system for an location finding a portable communication device according to the present invention can be realized in a centralized fashion in one computer system or processor, or in a distributed fashion where different elements are spread across several interconnected computer systems or processors (such as a microprocessor and a DSP). Any kind of computer system, or other apparatus adapted for carrying out the methods described herein, is suited. A typical combination of hardware and software could be a general purpose computer system with a computer program that, when being loaded and executed, controls the computer system such that it carries out the methods described herein.

The present invention can also be embedded in a computer program product, which comprises all the features enabling the implementation of the methods described herein, and which, when loaded in a computer system, is able to carry out these methods. A computer program or application in the present context means any expression, in any language, code or notation, of a set of instructions intended to cause a system having an information processing capability to perform a particular function either directly or after either or both of the following a) conversion to another language, code or notation; b) reproduction in a different material form.

Additionally, the description above is intended by way of example only and is not intended to limit the present invention in any way, except as set forth in the following claims.

What is claimed is:

1. A method of preventing the loss of a portable communication device, comprising the steps of:

monitoring an acceleration profile at the portable communication device; and entering a secure mode which limits access to the portable communication device upon determining the acceleration profile matches a predetermined acceleration profile.

2. The method of claim 1, wherein the method further comprises the step of transmitting location information from the portable communication device to one among a predetermined phone number, a predetermined voicemail, a predetermined email, and a remote requester having entered a predetermined access code.

3. The method of claim 1, wherein the method further comprises the step of alerting using at least one among a visual alert, an audible alert, a mechanical alert, and a tactile alert upon determining the acceleration profile matches the predetermined profile.

4. The method of claim 1, wherein the predetermined profile is a profile representing at least one among a dropped portable communication device and a portable communication device that has not been in motion for an extended period of time.

5. The method of claim 1, wherein the method comprises the step of obtaining location information using at least one among GPS Information, time of arrival techniques, and last known location information.

6. The method of claim 2, wherein the method comprises transmitting a time stamp along with location information.

7. The method of claim 1, wherein the method further comprises the steps of monitoring at the portable communication device for a predetermined safe zone and monitoring for a predetermined battery threshold.

8. The method of claim 7, wherein the method further comprises the step at the portable communication device of transmitting a location of the portable communication device to a predetermined destination when the portable communication device is outside the predetermined safe zone and when a battery is below the predetermined battery threshold.

9. A method of detecting the loss of a portable communication device, comprising the steps of:

monitoring an acceleration profile of the portable communication device;

determining from the acceleration profile if the portable communication device has been dropped and picked up; and entering the portable communication device into a security mode if the phone has been dropped only and a predetermined amount of time has lapsed.

10. The method of claim 9, wherein the security mode comprises the step of locking the portable communication device from further use until a security code is entered.

11. The method of claim 9, wherein the security mode comprises the step of alerting a user through at least one among an audio, a visual, a tactile, and a mechanical alert.

12. The method of claim 9, wherein the method further comprises the step of determining a geographical location of the portable communication device using at least one among GPS Information, time of arrival techniques, and last known location information.

13. The method of claim 12, wherein the security mode comprises the step of alerting a user of the portable communication device by sending the geographical information over the air to at least one among a predetermined phone number, a voicemail system, and an email account.

14. The method of claim 9, wherein the security mode comprises the step of alerting a user of the portable communication device by sending a canned message to at least one among a predetermined phone number, a voicemail system, and an email account.

15. The method of claim 9, wherein the method further comprises the step of determining a location of the portable communication device upon remotely receiving a request for location information using a predetermined passcode.

16. The method of claim 9, wherein the method further comprises the steps of monitoring at the portable communication device for a predetermined safe zone and monitoring for a predetermined battery threshold.

17. The method of claim 16, wherein the method further comprises the step at the portable communication device of transmitting a location of the portable communication device to a predetermined destination when the portable communication device is outside the predetermined safe zone and when a battery is below the predetermined battery threshold.

18. A portable communication device, comprising:

a transceiver;

an acceleration sensor coupled to the transceiver; and a processor coupled to the acceleration sensor, wherein the processor is programmed to:

monitor an acceleration profile of the portable communication device; and compare the acceleration profile of the portable communication device with at least one pre-stored acceleration profile.

19. The portable communication device of claim 18, wherein the acceleration sensor is an accelerometer.

20. The portable communication device of claim 18, wherein the processor is further programmed to determine from the acceleration profile if the portable communication device has been dropped and picked up within a predetermined time period.

21. The portable communication device of claim 18, wherein the processor is further programmed to entering the portable communication device into a security mode if the portable communication device has been dropped only and a predetermined amount of time has lapsed.

22. The portable communication device of claim 18, wherein the processor is further programmed to lock the portable communication device from further use until a security code is entered.

23. The portable communication device of claim 18, wherein the processor is further programmed to alert a user through at least one among an audio, a visual, a tactile, and a mechanical alert.

24. The portable communication device of claim 18, wherein the processor is further programmed to determine geographical information using at least one among GPS Information, time of arrival techniques, and last known location information.

25. The portable communication device of claim 24, wherein the processor is further programmed to alert the user of the loss of the portable communication device by sending the geographical information over the air to at least one among a predetermined phone number, a voicemail system, and an email account.

26. The portable communication device of claim 18, wherein the processor is further programmed to monitor for a predetermined safe zone, monitor for a predetermined battery threshold, and transmit a location of the portable communication device to a predetermined destination when the portable communication device is outside the predetermined safe zone and when a battery is below the predetermined battery threshold.

27. The portable communication device of claim 18, wherein the processor is further programmed to inhibit transmissions by the portable communication device when the portable communication device is in a predetermined safe zone.

* * * * *